US005531886A

United States Patent [19]

Cameron et al.

[11] Patent Number: 5,531,886

[45] Date of Patent: Jul. 2, 1996

[54] PROCESS FOR THE ELIMINATION OF ARSENIC FROM HYDROCARBONS BY PASSAGE OVER A PRESULPHURATED RETENTION MASS

[75] Inventors: Charles Cameron, Paris; Jean Cosyns, Maule; Patrick Sarrazin, Rueil Malmaison; Jean Paul Boitiau, Poissy; Philippe Courty, Houilles, all of Japan

[73] Assignee: Institut Francals du Petrole, Rueil Malmaison, France

[21] Appl. No.: 193,591

[22] Filed: Feb. 8, 1994

[30] Foreign Application Priority Data

Feb. 8, 1993 [FR] France ..... 93 01442

[51] Int. Cl.[6] ..... C10G 45/02

[52] U.S. Cl. ..... 208/251 H; 208/251 R; 208/177

[58] Field of Search ..... 208/251 H, 251 R, 208/177

[56] References Cited

U.S. PATENT DOCUMENTS

| | | | |
|---|---|---|---|
| 3,804,750 | 4/1974 | Myers et al. | 208/253 |
| 4,046,674 | 9/1977 | Young | 208/251 H |
| 4,069,140 | 1/1978 | Wunderlich | 208/251 H |
| 4,853,110 | 8/1989 | Singhal et al. | 208/253 |
| 5,153,163 | 10/1992 | Roumieu et al. | 502/222 |

FOREIGN PATENT DOCUMENTS

| | | |
|---|---|---|
| 0332526 | 9/1989 | European Pat. Off. . |
| 0357873 | 3/1990 | European Pat. Off. . |
| 0466568 | 1/1992 | European Pat. Off. . |
| WO90/10684 | 9/1990 | WIPO . |

*Primary Examiner*—Helane Myers

*Attorney, Agent, or Firm*—Millen, White, Zelano & Branigan

[57] ABSTRACT

A process for the elimination of arsenic from hydrocarbons with a retention mass wherein the retention mass is pretreated before being brought into contact with the feedstock to be purified. The retention mass contains at least one element selected from the group formed by iron, nickel, cobalt, molybdenum, tungsten, palladium and chromium. At least 5% by weight of these element(s) are in the sulfide form. The pretreatment involves impregnation with a sulfur compound carried out simultaneously with reduction. The arsenic elimination process is carried out between 120° C. and 250° C. in the presence of 0–1000 mg of sulfur/kg of feedstock

18 Claims, 1 Drawing Sheet

PROCESS FOR THE ELIMINATION OF ARSENIC FROM HYDROCARBONS BY PASSAGE OVER A PRESULPHURATED RETENTION MASS

The present invention concerns the elimination of arsenic from hydrocarbons. More particularly, the invention concerns the pretreatment of an arsenic retention mass which results in a very high retention efficiency from the initial startup period of the process.

BACKGROUND OF THE INVENTION

Liquid condensates (by-products of gas production) and some crude oils are known to contain numerous metallic trace compounds often in the form of organometallic complexes. These metallic compounds can frequently poison the catalysts used during transformation of these fractions into commercial products.

Purification of feedstocks for use in transformation processes for condensates or crudes is thus advantageous in order to avoid arsenic entrainment. Purification of the feedstock upstream of the treatment processes protects the installation assembly.

Some of the applicants' processes perform well as regards mercury or arsenic removal from liquid hydrocarbons used as feedstock for various treatment processes. U.S. patent U.S. Pat. No. 4,911,825 clearly demonstrates the advantage of mercury and possibly arsenic retention in a two step process wherein the first step consists in bringing the feedstock in the presence of hydrogen into contact with a catalyst containing at least one metal from the group constituted by nickel, cobalt, iron and palladium. Mercury is not (or is only slightly) retained by the catalyst but it is retained, in a second step, by a bed comprising sulfur or sulfur compounds.

Patent application WO 90/10 684 from the applicant describes a process for elimination of mercury and if necessary arsenic present in liquid hydrocarbons. This invention concerns catalysts having the ability to resist sulfur poisoning (thioresistance). These novel catalysts allow mercury and arsenic to be retained under conditions which are too severe for the catalysts described in the prior art.

This process is particularly useful in the purification of difficult feedstocks such as, for example, gas oils from fractionation of crude oil whose sulfur content is frequently between 0.4 and 1.0% by weight. On the other hand, the process described in U.S. patent U.S. Pat. No. 4,911,825 is more effective for feedstocks with a lower sulfur content, for example less than 0.15% by weight.

It has been established, however, that with some feedstocks having a low sulphur content, for example less than 0.07% by weight, the arsenic retention efficiency at the beginning of the arsenic removal process is lower in the first hundreds of hours than later on. It has also been found that the arsenic retention efficiency is lower for feedstocks with very low sulphur contents, for example less than 0.02% by weight. In the latter case, it is necessary to increase the operating temperature of the reactor by several dozen degrees and/or increase the hydrogen flowrate to retain sufficient arsenic.

U.S. patent U.S. Pat. No. 4,046,674 describes an arsenic elimination process (for quantities greater than 2 ppm) using a retention bed containing at least one nickel compound (comprising at least one sulphide) in quantities of 30–70% by weight NiO, and at least one molybdenum compound (comprising at least one sulphide) in quantities of 2–20% by weight $MoO_3$. This mixed sulphide absorbant requires the presence of large quantities of sulfur (greater than 0.1%) in the feedstock and high operating temperatures (of the order of 288° C. and 343° C. in the examples) in order to avoid desulfurization.

The present invention overcomes these drawbacks.

SUMMARY OF THE INVENTION

It has been discovered that pretreatment of the arsenic retention masses with a sulfur containing agent in the presence of a reducing agent results in a considerable reduction in the operating period of the process and in high arsenic retention efficiency even when a feedstock with a low sulfur content and low temperatures (less than or equal to 250° C.) are used.

The object of the present invention is to provide a process for the elimination of arsenic wherein the retention mass is pretreated before being contacted with the feedstock to be purified. According to this process, a mixture of feedstock and hydrogen is brought into contact with the presulfurated retention mass comprising at least one metal from the group formed by iron, nickel, cobalt, molybdenum, tungsten, chromium and palladium where at least 5% and in general at most 50% of the metal is in the form of the sulfide.

The retention mass used in the present invention is constituted by at least one metal M selected from the group formed by iron, nickel, cobalt, molybdenum, tungsten and palladium and a support. At least 5% and at most 50% of metal M must be in the form of its sulfide. Preferably, nickel or an association of nickel and palladium is used.

The solid mineral dispersant (support) may be selected from the group formed by alumina, aluminosilicates, silica, zeolites, activated carbon, clays and alumina cements. Preferably, it has a large surface area, a sufficient porous volume and an adequate average pore diameter. The BET surface area should be greater than 50 $m^2/g$, preferably between about 100 and 350 $m^2/g$. The support should have a porous volume, measured by nitrogen desorption, of at least 0.5 $cm^3/g$ and preferably between 0.6 and 1.2 $cm^3/g$ and an average pore diameter at least equal to 70 nm, preferably greater than 80 nm (1 nm=$10^{-9}$ m).

Preparation of a solid (or retention bed precursor) containing at least one metal M in metallic form or in the form of a supported metallic oxide is sufficiently known to the skilled person not to necessitate description within the scope of the present invention. The metal M content in the mass (calculated for the oxide form) is preferably at least 5% by weight and at most 60% by weight, more advantageously at most 30%. Palladium is a particular case, having at most 0.2% by weight of palladium (calculated for the metal).

The presulfuration process is described in patent EP-A-466 568 (whose teaching is hereby incorporated by reference).

The mass precursor comprising the supported metal(s) in the metallic and/or oxide form is a) in a first step, impregnated with an aqueous or organic solution or an aqueous or organic suspension comprising at least one organic reducing agent, and at least one sulfur containing agent selected from the group constituted by:

- at least one organic polysulfide mixed with elemental sulfur,
- at least one organic disulphide which may if necessary be mixed with elemental sulfur,
- at least one organic or inorganic sulphide which may if necessary be mixed with elemental sulfur, elemental sulfur, b) in a second step, the impregnated precursor is thermally treated. The temperature is, for example, between 100°–200° C., generally between 130°–170° C. and more particularly around 150° C. The treatment period is from 30 min to 3 h.

Sulfur addition may be carried out offsite by impregnating the retention mass precursor either with ammonium sulphide and/or with a colloidal suspension of sulfur in water, or with a sulphur containing agent, i.e., sulfur and/or one or more sulfur compounds, in organic solution. The reducing agent may be, for example, formaldehyde, acetaldehyde, hydrazine, methyl formate, formic acid, etc . . .

Before being brought into contact with the feedstock to be treated, the retention mass is, if necessary, reduced by hydrogen or by a hydrogen containing gas at a temperature of 120° C. to 600° C., preferably 140° C. to 400° C.

The presulfurated then reduced solid thus prepared constitutes the retention mass of the present invention in its active form.

The retention mass may be used in a temperature range of 120° C. to 250° C., more advantageously 130° C. to 220° C., or even 130°–200° C., preferably 140°–190° C. and most preferably 140° C. to 180° C. Operating pressures are preferably from 1 to 40 bars and more advantageously from 5 to 35 bars. Volume flows calculated with respect to the retention mass may be from 1 to 50 $h^{-1}$, more particularly from 1 to 30 $h^{-1}$ (volume of liquid per volume of mass per hour).

The hydrogen flowrate relative to the retention mass may be, for example, between 1 and 500 volumes (gas under normal conditions) per volume of bed per hour.

The invention is particularly applicable to feedstocks comprising 0 to 1000 milligrams of sulfur per kilogram of feedstock and from $10^{-3}$ to 5 milligrams of arsenic per kilogram of feedstock.

The following examples further describe the process without in any way limiting its scope.

EXAMPLES

Retention mass A: Fifteen kilograms of a macroporous alumina support in the form of spheres of 1.5–3 mm diameter having a specific surface area of 160 $m^2/g$, a total pore volume of 1.05 $cm^3/g$ and a macroporous volume (diameter>0.1 μm) of 0.4 $cm^3/g$ were impregnated with 20% by weight of nickel in the form of an aqueous nitrate solution. Following drying at 120° C. for 5 h and thermal activation at 450° C. for 2 h in a current of air, spheres containing 25.4% by weight of nickel oxide were obtained.

Retention mass B: Five kilograms of mass A were dry impregnated with a solution comprising 175 g of DEODS, diethanoldisulfide, (74 g of sulfur) in 5150 $cm^3$ of a solution of 15% methyl formate in white spirit. The catalyst thus prepared was activated at 150° C. for 1 h.

The retention mass (50 $cm^3$) was used in all the examples below at 180° C. and with an upward feed. Retention tests lasted 21 days. The results are shown in FIG. 1.

Example 1

(Comparative)

Retention mass A was reduced at 400° C. in hydrogen at a flowrate of 20 l/h and pressure of 2 bars for 4 h. The reactor was then cooled to the reaction temperature of 180° C. A heavy condensate from liquid gas was then passed with hydrogen over the retention mass. The feedstock flowrate was 400 $cm^3/h$ and that of the hydrogen, 3.5 l/h. The test was carried out at a pressure of 35 bars.

The condensate used in this test (condensate A) had the following characteristics:

initial boiling point: 21° C.

final boiling point: 470° C.

arsenic content: 65 μg/kg sulfur content: 237 mg/kg

A quantity of arsenic, from 5 to 10 μg/kg, was detected in effluent samples taken over the first 72 hours.

Example 2

(Comparative)

A second arsenic retention test was carried out using a condensate (condensate B) having the following characteristics:

initial boiling point: 21° C.

final boiling point: 491° C.

arsenic content: 80 μg/kg sulfur content: 117 mg/kg

The prereduction and operating conditions were identical to those of the test of example 1. The arsenic content of the effluents, as for example 1, were from 5 to 10 μg/kg over the first 240 hours of operation.

Example 3

(In Accordance With the Invention)

The reactor was loaded with 50 $cm^3$ of retention mass B, presulfurated as described above. All other test conditions were identical to those indicated in example 1 including the feedstock (condensate A). The arsenic content remained below the detection level (<5 μg/kg) during the entire test.

Example 4

(In Accordance With the Invention)

In this instance, retention mass B was reduced at 300° C. in hydrogen at a flowrate of 20 l/h and pressure of 2 bars for 6 h before cooling to the reaction temperature of 180° C. Here too the arsenic content in the effluent was below the detection limit (<5 μg/kg) during the entire test.

BRIEF DESCRIPTION OF THE DRAWINGS

The test results are shown in FIG. 1.

The values given below the line indicate concentrations below the detection limit. The symbols have been offset to facilitate reading of the FIGURE and do not represent real values.

Figure 1:
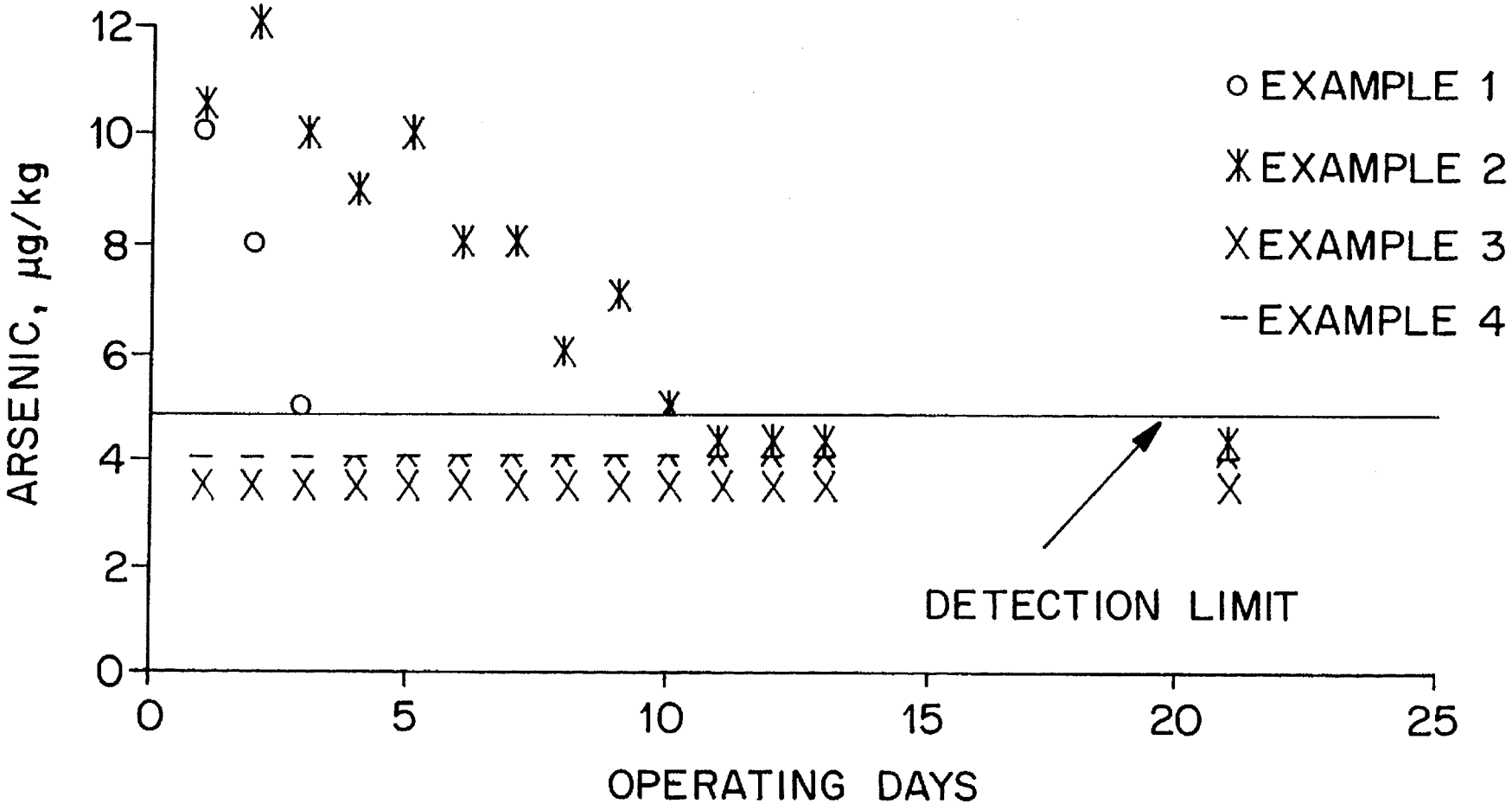

We claim:

1. A process for the elimination of arsenic from a hydrocarbon feedstock containing arsenic which comprises mixing the feedstock, which contains from 0 to 1000 mg of sulfur/kg, with hydrogen and contacting it, at a temperature of 120°–250° C., a pressure of 1–40 bars and a volume flow of 1 to 50 $h^{-1}$, with a retention mass comprising a support and at least one metal selected from the group consisting of iron, nickel, cobalt, molybdenum, tungsten, chromium and palladium, 5–50% by weight of said metal or metals being in the form of a sulfide, and wherein the retention mass is obtained by impregnating a precursor comprising said supported metal or metals, in the metallic or oxide form, with an aqueous or organic solution or an aqueous or organic suspension comprising at least one reducing agent and at least one sulfur containing agent selected from the group consisting of a) at least one organic polysulfide mixed with elemental sulfur, b) at least one organic disulfide, optionally mixed with elemental sulfur, c) at least one organic or inorganic sulfide, optionally mixed with elemental sulfur, and d) elemental sulfur, and thermally treating the precursor after impregnation, but before contacting it with the feedstock.

2. A process according to claim 1, wherein the flowrate of hydrogen mixed with the feedstock is between 1 and 500 volumes of gas per volume of retention mass and per hour.

3. A process according to claim 1, wherein the feedstock contains $10^{-3}$ to 5 mg of arsenic per kg of feedstock.

4. A process according to claim 1, wherein the metal is nickel.

5. A process according to claim 1, wherein the metals are nickel and palladium.

6. A process according to claim 1, wherein the support is selected from the group consisting of alumina, aluminosilicates, silica, zeolites, activated carbon, clays and alumina cements.

7. A process according to claim 1, wherein the sulfide form is produced by offsite impregnation of the retention mass precursor, using at least one sulfur containing liquid selected from the group consisting of ammonium sulfide, a colloidal suspension of sulfur in water, an organic solution of sulfur, and an organic solution of sulfur containing compound(s).

8. A process according to claim 1, wherein the feedstock is brought into contact with the mass at a temperature of 130°–200° C.

9. A process according to claim 1, wherein the metal content of the mass (calculated as the metal oxide) is at most 30% by weight, the metal being other than palladium.

10. A process according to claim 1, wherein at least one metal is palladium and the palladium content (calculated as the metal) is at most 0.2%.

11. A process according to claim 1, wherein the precursor is reduced in hydrogen at 120°–600° C. before being brought into contact with the feedstock.

12. A process according to claim 1, wherein the precursor is thermally treated at between 100° C. and 200° C. after impregnation.

13. A process according to claim 6, the support having a BET surface area greater than 50 $m^2/g$, a pore volume measured by nitrogen desorption of at least 0.5 $cm^3/g$, and an average pore diameter at least equal to 70 nm.

14. The process of claim 1, wherein the reducing agent is formaldehyde, acetaldehyde, hydrazine, methyl formate or formic acid.

15. The process of claim 1, wherein the metal content of the mass, calculated as the metal oxide, is from 5 to 60% by weight, the metal being other than palladium.

16. The process of claim 1, wherein the feedstock is contacted with the mass at a temperature of 120°–200° C.

17. The process of claim 1, wherein the feedstock is contacted with the mass at a temperature of 120°–180° C.

18. The process of claim 1, wherein the metal in the mass not in the sulfide form is in the metal form.

* * * * *